US012595616B2

(12) United States Patent
Damtew

(10) Patent No.: US 12,595,616 B2
(45) Date of Patent: Apr. 7, 2026

(54) WASHING MACHINE APPLIANCE AND STEAM-GENERATING FEATURES FOR THE SAME

(71) Applicant: Haier US Appliance Solutions, Inc., Wilmington, DE (US)

(72) Inventor: FikreAdam Abebe Damtew, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 84 days.

(21) Appl. No.: 18/632,895

(22) Filed: Apr. 11, 2024

(65) Prior Publication Data

US 2025/0320653 A1 Oct. 16, 2025

(51) Int. Cl.
*D06F 39/08* (2006.01)
*D06F 39/02* (2006.01)

(52) U.S. Cl.
CPC ..... *D06F 39/088* (2013.01); *D06F 39/022* (2013.01); *D06F 39/028* (2013.01); *D06F 39/083* (2013.01)

(58) Field of Classification Search
CPC .... D06F 39/022; D06F 39/083; D06F 39/088; D06F 39/20
See application file for complete search history.

(56) References Cited

U.S. PATENT DOCUMENTS 2,885,879 A * 5/1959 Bloom ..... D06F 39/087 210/97
3,822,571 A * 7/1974 Waugh ..... D06F 39/02 68/17 R
5,606,878 A * 3/1997 Arreghini ..... D06F 39/20 68/17 R
9,732,957 B2 8/2017 Beck et al.
2004/0255391 A1 12/2004 Kim et al.
2008/0040868 A1 2/2008 Wong et al.
(Continued)

FOREIGN PATENT DOCUMENTS

DE 102012223682 A1 * 6/2014 ..... D06F 58/20
DE 102012105091 B4 11/2017
DE 102015107702 B4 12/2019

OTHER PUBLICATIONS

DE102012223682A1 Machine Translation (Year: 2014).*

*Primary Examiner* — Spencer E. Bell
(74) *Attorney, Agent, or Firm* — Dority & Manning, P.A.

(57) ABSTRACT

A washing machine appliance may include a cabinet, a tub, a wash basket, an additive dispensing assembly, and a passive buffer compartment. The additive dispensing assembly may be positioned within the cabinet. The additive dispensing assembly may include a water supply valve, a water supply conduit, and an additive dispenser. The water supply conduit may extend between the water supply valve and the tub. The additive dispenser may be in selective fluid communication with the water supply conduit upstream of the tub. The passive buffer compartment may be disposed in fluid communication between the water supply valve and the additive dispenser. The passive buffer compartment may define an internal volume, a buffer inlet upstream from the internal volume, a dispenser outlet upstream from the additive dispenser, and a buffer outlet upstream from the tub in fluid parallel to the dispenser outlet to bypass the additive dispenser.

20 Claims, 4 Drawing Sheets

(56) References Cited

U.S. PATENT DOCUMENTS

2011/0056250 A1* 3/2011 Kim ..... D06F 39/028
68/17 R
2020/0340168 A1 10/2020 Leung et al.

* cited by examiner

WASHING MACHINE APPLIANCE AND STEAM-GENERATING FEATURES FOR THE SAME

FIELD OF THE DISCLOSURE

The present subject matter relates generally to washing machine appliances, and more particularly to steam-generating features for the same.

BACKGROUND OF THE DISCLOSURE

Washing machine appliances generally include a tub for containing water or wash liquid (e.g., water and detergent, bleach, or other wash additives). A basket is rotatably mounted within the tub and defines a wash chamber for receipt of articles for washing. During normal operation of such washing machine appliances, the wash liquid is directed into the tub and onto articles within the wash chamber of the basket. The basket or an agitation element can rotate at various speeds to agitate articles within the wash chamber, to wring wash fluid from articles within the wash chamber, etc.

Certain washing machine appliances can clean articles disposed therein using steam. Steam can increase certain wash cycles' efficiency and effectiveness. For example, steam can decrease the amount of time or water needed to clean articles. Also, steam can assist in reducing wrinkles or odors in articles cleaned by such washing machine appliances. In order to generate steam, existing washing machines appliances often include a steam generator in which steam is generated and subsequently piped to a wash chamber of the appliance. Other existing appliances may attempt to generate steam directly within a wash chamber.

Nonetheless, challenges exist with current systems. For instance, existing steam generators may require extensive additional parts or steps for assembly. Such additions may add to the cost of the appliance or reduce overall reliability. Additionally or alternatively, existing systems may risk wetting clothes within the wash chamber prior to steam generation. In turn, the efficacy of the generated steam or the efficiency of the system may be reduced.

As a result, it would be advantageous to provide a washing machine appliance—or features for the same—addressing one or more of the above-identified issues.

BRIEF DESCRIPTION OF THE DISCLOSURE

Aspects and advantages of the invention will be set forth in part in the following description, or may be obvious from the description, or may be learned through practice of the invention.

In one exemplary aspect of the present disclosure, a washing machine appliance is provided. The washing machine appliance may include a cabinet, a tub, a wash basket, an additive dispensing assembly, and a passive buffer compartment. The cabinet may define an opening to receive articles therethrough. The tub may be positioned within the cabinet. The wash basket may be rotatably mounted within the tub. The wash basket may define a wash chamber for receiving articles for washing. The additive dispensing assembly may be positioned within the cabinet and configured to provide wash fluid to the tub. The additive dispensing assembly may include a water supply valve, a water supply conduit, and an additive dispenser. The water supply valve may selectively direct water to the tub. The water supply conduit may extend between the water supply valve and the tub. The additive dispenser may be in selective fluid communication with the water supply conduit upstream of the tub. The passive buffer compartment may be disposed in fluid communication between the water supply valve and the additive dispenser. The passive buffer compartment may define an internal volume, a buffer inlet upstream from the internal volume, a dispenser outlet upstream from the additive dispenser, and a buffer outlet upstream from the tub in fluid parallel to the dispenser outlet to bypass the additive dispenser.

In another exemplary aspect of the present disclosure, a washing machine appliance is provided. The washing machine appliance may include a cabinet, a tub, a wash basket, an additive dispensing assembly, a passive buffer compartment, and an electric heating element. The cabinet may define an opening to receive articles therethrough. The tub may be positioned within the cabinet. The wash basket may be rotatably mounted within the tub. The wash basket may define a wash chamber for receiving articles for washing. The additive dispensing assembly may be positioned within the cabinet and configured to provide wash fluid to the tub. The additive dispensing assembly may include a water supply valve, a water supply conduit, and an additive dispenser. The water supply valve may selectively direct water to the tub. The water supply conduit may extend between the water supply valve and the tub. The additive dispenser may be in selective fluid communication with the water supply conduit upstream of the tub. The passive buffer compartment may be disposed in fluid communication between the water supply valve and the additive dispenser. The passive buffer compartment may define an internal volume, a buffer inlet upstream from the internal volume, a dispenser outlet upstream from the additive dispenser, and a buffer outlet upstream from the tub in fluid parallel to the dispenser outlet to bypass the additive dispenser. The buffer outlet may be smaller than the buffer inlet to define a sump flowrate less than a buffer flowrate of the buffer inlet. The electric heating element may be disposed at a bottom end of the tub.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
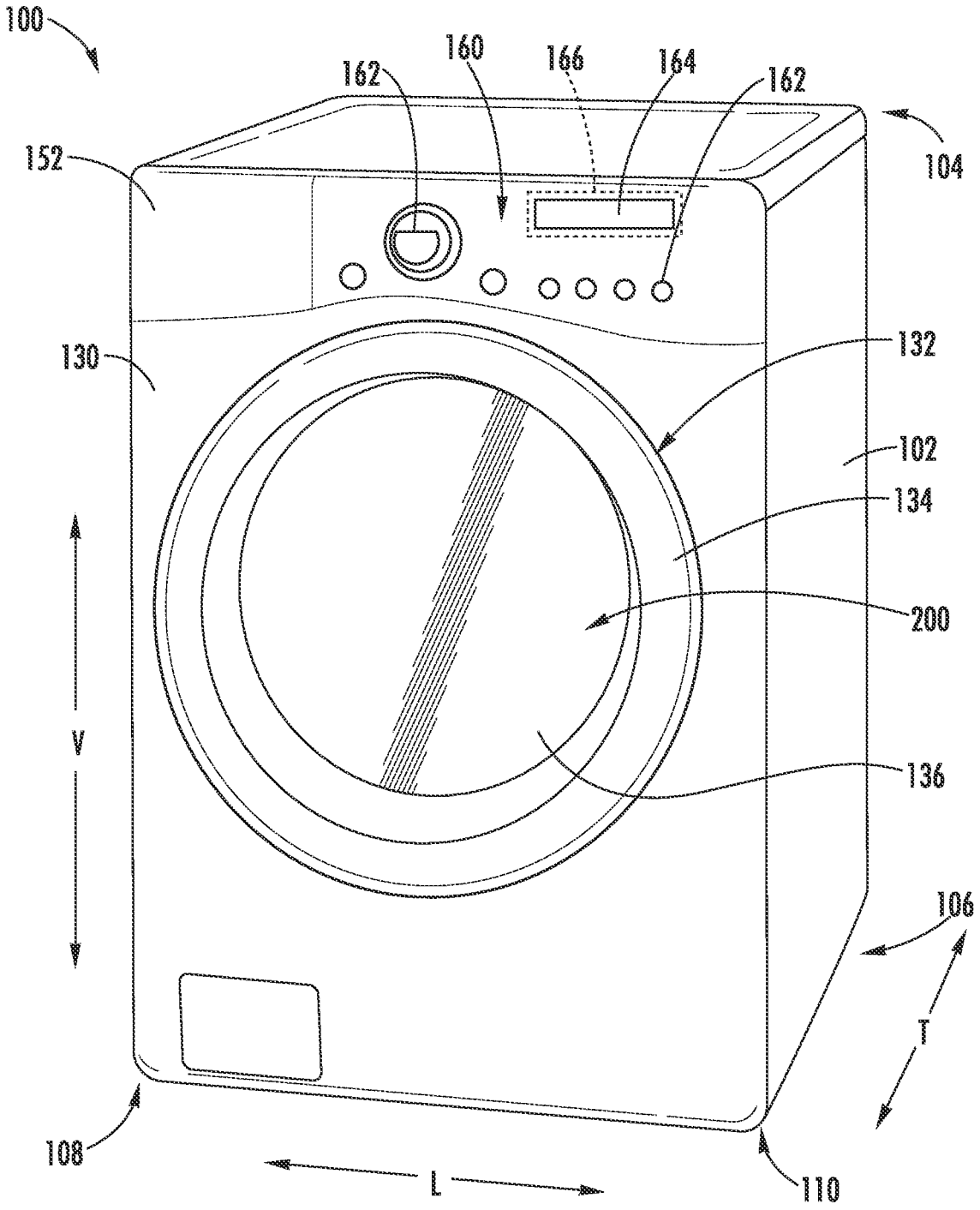
FIG. 1 provides a perspective view of a washing machine appliance according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents. The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

Except as explicitly indicated otherwise, recitation of a singular processing element (e.g., "a controller," "a processor," "a microprocessor," etc.) is understood to include more than one processing element. In other words, "a processing element" is generally understood as "one or more processing element." Furthermore, barring a specific statement to the contrary, any steps or functions recited as being performed by "the processing element" or "said processing element" are generally understood to be capable of being performed by "any one of the one or more processing elements." Thus, a first step or function performed by "the processing element" may be performed by "any one of the one or more processing elements," and a second step or function performed by "the processing element" may be performed by "any one of the one or more processing elements and not necessarily by the same one of the one or more processing elements by which the first step or function is performed." Moreover, it is understood that recitation of "the processing element" or "said processing element" performing a plurality of steps or functions does not require that at least one discrete processing element be capable of performing each one of the plurality of steps or functions.

Exemplary aspects of the present disclosure may advantageously permit steam generation within a washing machine appliance without requiring significant additional actively controlled components (e.g., valves in comparison to existing non-steam generating appliances) or otherwise reducing reliability of the appliance. Additional or alternative aspects of the present disclosure may advantageously prevent clothes within the appliance from being wetted prior to steam generation.

Figure 2:
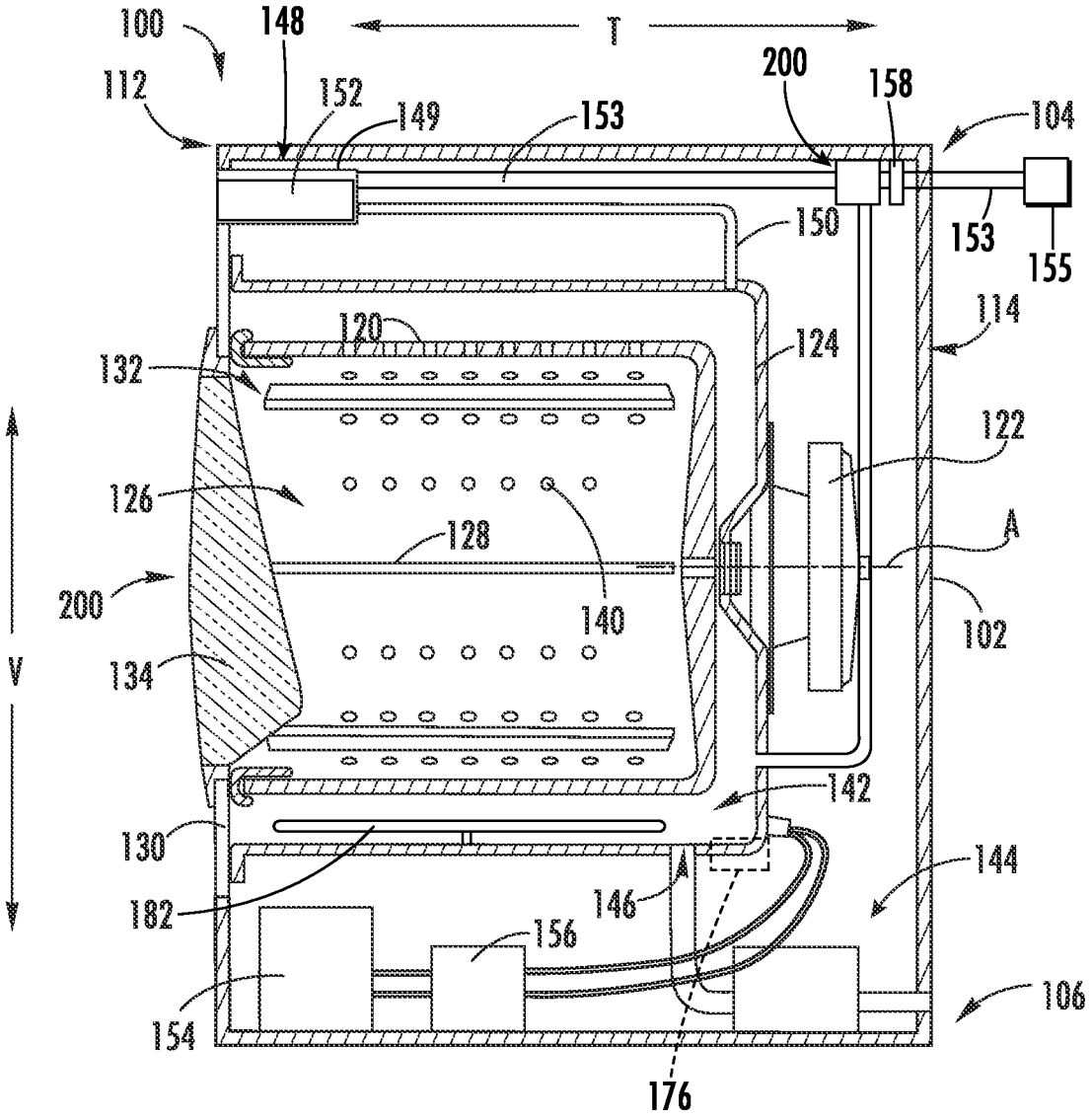
FIG. 2 provides a cross-sectional side view of the exemplary washing machine appliance of FIG. 1.

Referring now to the figures, FIG. 1 is a perspective view of an exemplary horizontal axis washing machine appliance 100, and FIG. 2 is a side cross-sectional view of washing machine appliance 100. As illustrated, washing machine appliance 100 generally defines a vertical direction V, a lateral direction L, and a transverse direction T, each of which is mutually perpendicular, such that an orthogonal coordinate system is defined. Washing machine appliance 100 includes a cabinet 102 that extends between a top 104 and a bottom 106 along the vertical direction V, between a left side 108 and a right side 110 along the lateral direction L, and between a front 112 and a rear 114 along the transverse direction T.

Referring to FIG. 2, a wash tub 124 is positioned within cabinet 102 and is generally configured for retaining wash fluids during an operating cycle. As used herein, "wash fluid" may refer to water, detergent, fabric softener, bleach, or any other suitable wash additive or combination thereof. Wash tub 124 is substantially fixed relative to cabinet 102 such that it does not rotate or translate relative to cabinet 102.

A wash basket 120 is received within wash tub 124 and defines a wash chamber 126 that is configured for receipt of articles for washing. More specifically, wash basket 120 is rotatably mounted within wash tub 124 such that it is rotatable about an axis of rotation A. According to the illustrated embodiments, the axis of rotation A is substantially parallel to the transverse direction T. In this regard, washing machine appliance 100 is generally referred to as a "horizontal axis" or "front load" washing machine appliance 100.

Wash basket 120 may define one or more agitator features that extend into wash chamber 126 to assist in agitation and cleaning articles disposed within wash chamber 126 during operation of washing machine appliance 100. For example, as illustrated in FIG. 2, a plurality of ribs 128 extends from basket 120 into wash chamber 126. In this manner, for example, ribs 128 may lift articles disposed in wash basket 120 during rotation of wash basket 120.

Washing machine appliance 100 includes a motor assembly 122 that is in mechanical communication with wash basket 120 to selectively rotate wash basket 120 (e.g., during an agitation or a rinse cycle of washing machine appliance 100). According to the illustrated embodiments, motor assembly 122 is a pancake motor. However, it should be appreciated that any suitable type, size, or configuration of motor may be used to rotate wash basket 120 according to alternative embodiments.

Referring generally to FIGS. 1 and 2, cabinet 102 also includes a front panel 130 that defines an opening 132 that permits user access to wash basket 120 of wash tub 124. More specifically, washing machine appliance 100 includes a door 134 that is positioned over opening 132 and is rotatably mounted to front panel 130 (e.g., about a door axis that is substantially parallel to the vertical direction V). In this manner, door 134 permits selective access to opening 132 by being movable between an open position (not shown) facilitating access to a wash tub 124 and a closed position (FIG. 1) prohibiting access to wash tub 124. Optionally, a lock assembly may be fixed to cabinet 102 to selectively lock or hold a free end of the door 134 to cabinet 102 when door 134 is in the closed position (e.g., during certain operations or wash cycles).

In some embodiments, a window 136 in door 134 permits viewing of wash basket 120 when door 134 is in the closed position (e.g., during operation of washing machine appliance 100). Door 134 also includes a handle (not shown) that, for example, a user may pull when opening and closing door 134. Further, although door 134 is illustrated as mounted to front panel 130, it should be appreciated that door 134 may be mounted to another side of cabinet 102 or any other suitable support according to alternative embodiments. Additionally or alternatively, a front gasket or baffle may extend between tub 124 and the front panel 130 about the opening 132 covered by door 134, further sealing tub 124 from cabinet 102.

As shown, wash basket 120 defines a plurality of perforations 140 in order to facilitate fluid communication between an interior of basket 120 and wash tub 124. A sump 142 is defined by wash tub 124 at a bottom of wash tub 124 along the vertical direction V. Thus, sump 142 is configured for receipt of, and generally collects, wash fluid during operation of washing machine appliance 100. For example, during operation of washing machine appliance 100, wash fluid may be urged (e.g., by gravity) from basket 120 to sump 142 through plurality of perforations 140. A pump assembly 144 is located beneath wash tub 124 for gravity assisted flow when draining wash tub 124 (e.g., via a drain 146). Pump assembly 144 may also be configured for recirculating wash fluid within wash tub 124.

In some embodiments, an electric heating element 182 is provided with wash tub 124. Specifically, at least one electric heating element 182 may be disposed on wash tub 124. For instance, electric heating element 182 may be mounted within wash tub 124 (e.g., within the wash chamber 126 defined by the same). In some such embodiments, electric heating element 182 is mounted at or within a bottom portion of the wash tub 124 (e.g., below the wash basket), such as within the sump 142. Generally, the electric heating element 182 may include or be provided as any suitable electrically activated heating element 182, such as an electric resistance element, a microwave element, an induction element, or combination thereof. During use, such as during a selected steam phase (e.g., before a wash or rinse phase), the electric heating element 182 may be activated to generate steam from water within the sump 142. As will be described in greater detail below, such water may be supplied through a passive buffer compartment 200, notably without passing through or over clothes within the wash basket 120.

In some embodiments, washing machine appliance 100 includes an additive dispensing assembly 148 for providing wash fluid to the wash tub 124. Specifically, additive dispensing assembly 148 may include an additive dispenser or spout 150 for storing and dispensing a wash additive. For example, additive dispenser or spout 150 may include a line and outlet from which wash fluid is dispensed to the wash tub 124. In turn, spout 150 may be in fluid communication with a water supply valve 158 and supply conduit 153 in order to direct fluid (e.g., wash fluid) into wash tub 124 (e.g., at a position above or at the same height of wash basket 120). During use, water may be supplied to the supply conduit 153, water supply valve 158, and spout 150 from an upstream water supply source (such as a municipal water supply 155). As shown, additive dispensing assembly 148 may also be in fluid communication with the sump 142. For example, pump assembly 144 may direct wash fluid disposed in sump 142 to additive dispensing assembly 148 in order to circulate wash fluid in wash tub 124.

As illustrated, a detergent drawer 152 may be slidably mounted within front panel 130. Detergent drawer 152 receives a wash additive (e.g., detergent, fabric softener, bleach, or any other suitable liquid or powder) and directs the fluid additive to wash chamber 126 during certain operations or wash cycle phases of washing machine appliance 100. According to the illustrated embodiment, detergent drawer 152 may also be fluidly coupled to spout 150 to facilitate the complete and accurate dispensing of wash additive.

In optional embodiments, a bulk reservoir 154 is disposed within cabinet 102. Bulk reservoir 154 may be configured for receipt of fluid additive for use during operation of washing machine appliance 100. Moreover, bulk reservoir 154 may be sized such that a volume of fluid additive sufficient for a plurality or multitude of wash cycles of washing machine appliance 100 (e.g., five, ten, twenty, fifty, or any other suitable number of wash cycles) may fill bulk reservoir 154. Thus, for example, a user can fill bulk reservoir 154 with fluid additive and operate washing machine appliance 100 for a plurality of wash cycles without refilling bulk reservoir 154 with fluid additive. A reservoir pump 156 is configured for selective delivery of the fluid additive from bulk reservoir 154 to wash tub 124.

A water supply valve or control valve 158 may provide a flow of water from a water supply source (such as a municipal water supply 155) into detergent drawer 152 or into tub 124. As described below, a passive buffer compartment 200 may be provided to direct at least a portion of water from the control valve 158 to wash tub 124 (e.g., directly) and detergent drawer 152. In this manner, control valve 158 may generally be operable to supply water into tub 124 or detergent drawer 152 to generate a wash fluid (e.g., for use in a wash cycle) or a flow of fresh water (e.g., for a rinse phase or steam phase), as will be described in greater detail below. It should be appreciated that control valve 158 may be positioned at any other suitable location within cabinet 102.

In some embodiments, a control panel 160 including a plurality of input selectors 162 is coupled to front panel 130. Control panel 160 and input selectors 162 may collectively form a user interface input for operator selection of machine cycles and features. For example, in exemplary embodiments, a display 164 indicates selected features, a countdown timer, or other items of interest to machine users.

Operation of washing machine appliance 100 is generally controlled by a controller or processing device 166. In some embodiments, controller 166 is in operative communication with (e.g., electrically or wirelessly connected to) control panel 160 for user manipulation to select washing machine cycles and features. In response to user manipulation of control panel 160, controller 166 operates the various components of washing machine appliance 100 to execute selected machine cycles and features.

Controller 166 may include a memory (e.g., non-transitive memory) and microprocessor, such as a general or special purpose microprocessor operable to execute programming instructions or micro-control code associated with a wash operation. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 166 may be constructed without using a microprocessor (e.g., using a combination of discrete analog or digital logic circuitry, such as switches, amplifiers, integrators, comparators, flip-flops, AND gates, and the like) to perform control functionality instead of relying upon software. Control panel 160 and other components of washing machine appliance 100, such as motor assembly 122, control valve 158, or pressure sensor 176, may be in operative communication with controller 166 via one or more signal lines or shared communication busses.

In some embodiments, a pressure sensor 176 is provided in operative communication with tub 124. For instance, pressure sensor 176 may communicate with the tub 124 through a sidewall thereof. Pressure sensor 176 may be configured to detect or measure pressure within the tub 124. In particular, pressure sensor 176 may detect or measure pressure generated by the liquid held within tub 124 (e.g., during a wash cycle). In some such embodiments, pressure signals detected at pressure sensor 176 may be transmitted to and received by controller 166. Controller 166 may be configured to determine the pressure within tub 124 (or the volume of liquid therein) based on the received pressure signals. As would be understood, pressure sensor 176 may be formed as any suitable pressure detecting device, such as a piezoresistive, capacitive, electromagnetic, piezoelectric, or optical pressure detecting device.

Turning now generally to FIGS. 2 through 6, a passive buffer compartment 200 may be provided between the control valve 158 and the additive dispenser 150. In particular, the passive buffer compartment 200 may be disposed in fluid communication between the water supply valve 158 and the additive dispenser 150. Thus, the passive buffer compartment 200 may be mounted along a fluid path from a portion of water supply conduit 153 at a position that is downstream from the water supply valve 158 and upstream from the additive dispenser 150. As will be described in greater detail below, passive buffer compartment 200 defines an internal volume 210 (e.g., enlarged volume) and a buffer inlet 212 (e.g., upstream from the internal volume 210 and downstream from the water supply valve 158). The passive buffer compartment 200 may be larger (e.g., define a greater cross-sectional area or volume) than one or more adjacent portions of the fluid path, including buffer inlet 212 or the supply conduit 153 directly upstream from the compartment 200. Thus, water flowing from the water supply valve 158 may accumulate (e.g., to a set water volume) before flowing out of passive buffer compartment 200 (e.g., through one or more outlets 214, 216).

In some embodiments, passive buffer compartment 200 defines two or more outlets (e.g., downstream from buffer inlet 212 and internal volume 210). As an example, a dispenser outlet 214 may be defined downstream from internal volume 210 and upstream from the additive dispenser 150. Generally, the dispenser outlet 214 may be smaller (e.g., define a smaller cross-sectional area relative to the direction of water flow) than the internal volume 210 or buffer inlet 212. In turn, the dispenser outlet 214 may define a dispenser flowrate for water from dispenser outlet 214 that is less than a buffer flowrate at or from the buffer inlet 212. As an additional or alternative example, a buffer outlet 216 may be defined downstream from internal volume 210 and upstream from the wash tub 124. As shown, buffer outlet 216 may be defined in fluid parallel to the dispenser outlet 214. In turn, water from the buffer outlet 216 may bypass the additive dispenser 150 (e.g., to flow directly to wash tub 124). Generally, the buffer outlet 216 may be smaller (e.g., define a smaller cross-sectional area relative to the direction of water flow) than the internal volume 210 or buffer inlet 212. In turn, the buffer outlet 216 may define a sump flowrate for water from buffer outlet 216 that is less than a buffer flowrate at or from the buffer inlet 212. Optionally, the buffer outlet 216 may be smaller (e.g., define a smaller cross-sectional area relative to the direction of water flow) than the dispenser outlet 214. In turn, the buffer outlet 216 may define the sump flowrate for water from buffer outlet 216 that is less than a dispenser flowrate at or from dispenser outlet 214. In some embodiments, the passive buffer compartment 200 is free of any additional valves or active movable elements (e.g., to direct water therethrough). As a result, the relationship of water flow through the passive buffer compartment 200 may be generally set in advance and controlled via the opening-closing of control valve 158.

As shown, the buffer outlet 216 may be defined along a portion of internal volume 210 or passive buffer compartment 200 that is upstream from the location of dispenser outlet 214. Thus, at least a portion of water from the buffer inlet 212 may first encounter or pass buffer outlet 216 without (or before) encountering dispenser outlet 214. In certain embodiments, the buffer outlet 216 is disposed below (e.g., at a lower height relative to the vertical direction V) than the dispenser outlet 214. Thus, the dispenser outlet 214 may be located above the buffer outlet 216. Optionally, the buffer outlet 216 may be further disposed below the buffer inlet 212.

In certain embodiments, the passive buffer compartment 200 defines a plurality of separate chambers that are in at least partial fluid communication. For instance, passive buffer compartment 200 may define a buffer chamber 222 and an overflow chamber 224 within or as part of internal volume 210—both chambers 222, 224 being generally downstream from the buffer inlet 212. Specifically, the buffer chamber 222 may be in fluid communication between the buffer inlet 212 and the buffer outlet 216. In turn, the buffer chamber 222 may be downstream from the buffer inlet 212 and upstream from the buffer outlet 216. Water flowed from the buffer inlet 212 to the buffer outlet 216 may, thus, be required to flow through the buffer chamber 222. By contrast, the overflow chamber 224 may be in fluid communication between the buffer chamber 222 and the dispenser outlet 214. In turn, overflow chamber 224 may be downstream from the buffer chamber 222 and upstream from the dispenser outlet 214. Water flowed from the buffer inlet 212 to the dispenser outlet 214 may, thus, be required to flow through the buffer chamber 222 (e.g., without flowing to the buffer outlet 216) and then the overflow chamber 224.

In optional embodiments, the passive buffer compartment 200 includes an internal wall 226 (e.g., within the internal volume 210) between the buffer chamber 222 and the overflow chamber 224. For instance, the buffer chamber 222 may separate the buffer chamber 222 and the overflow chamber 224. The internal wall 226 may be provided as a solid, non-permeable member. Moreover, the internal wall 226 may serve as a horizontal barrier between the buffer chamber 222 and the overflow chamber 224. In some embodiments, the internal wall 226 defines—at least in part—a reduced throat 228 that restricts water flow from the buffer chamber 222 to the overflow chamber 224. Thus, the fluid path through the passive buffer compartment 200 may be constricted at the reduced throat 228. As shown, the reduced throat 228 may be disposed above the internal wall 226. Thus, in the illustrated embodiments, the reduced throat 228 is defined between a top end of the internal wall 226 and an inner surface of the passive buffer compartment 200. When assembled, the internal wall 226 and reduced throat 228 may be disposed above (e.g., at a higher position relative to the vertical direction V) than the buffer outlet 216. Thus, at least a portion of the water flowed into internal volume 210 from the buffer inlet 212 may be directed or permitted to the buffer outlet 216 before another portion of the water is able to flow through the reduced throat 228 to the overflow chamber 224. For instance, a certain volume of water may be required to fill the buffer chamber 222 (e.g., while some water passes through the buffer outlet 216) before any water is able to flow through the reduced throat 228 or otherwise to the overflow chamber 224.

Figure 3:
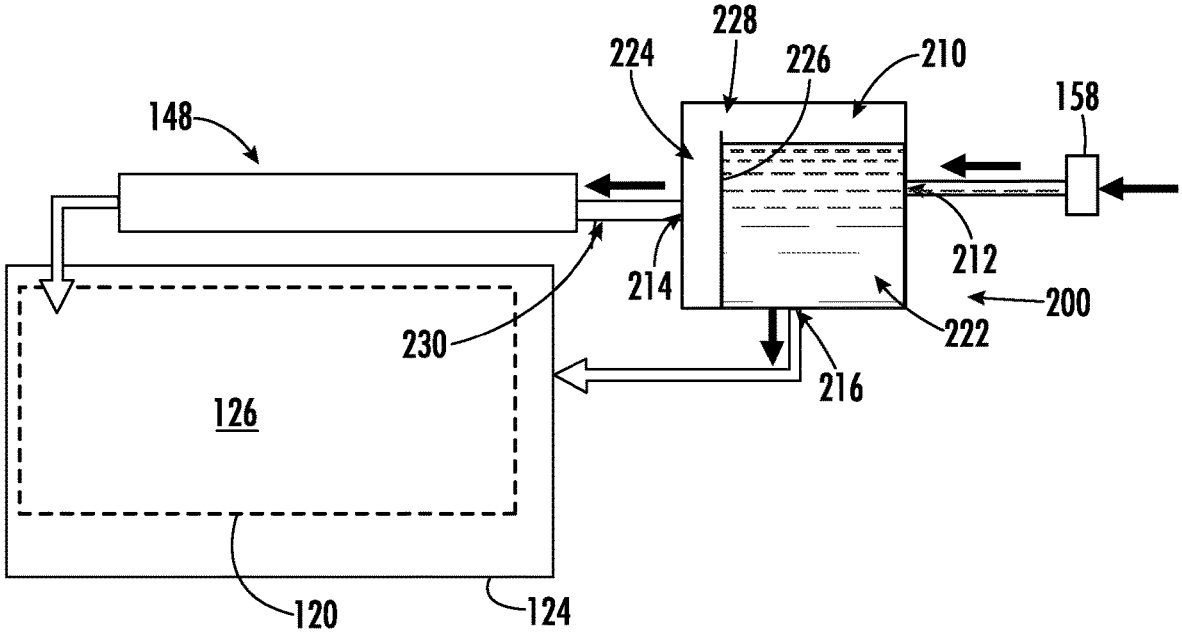
FIG. 3 provides a schematic view of a washing machine appliance according to exemplary embodiments of the present disclosure.
Figure 4:
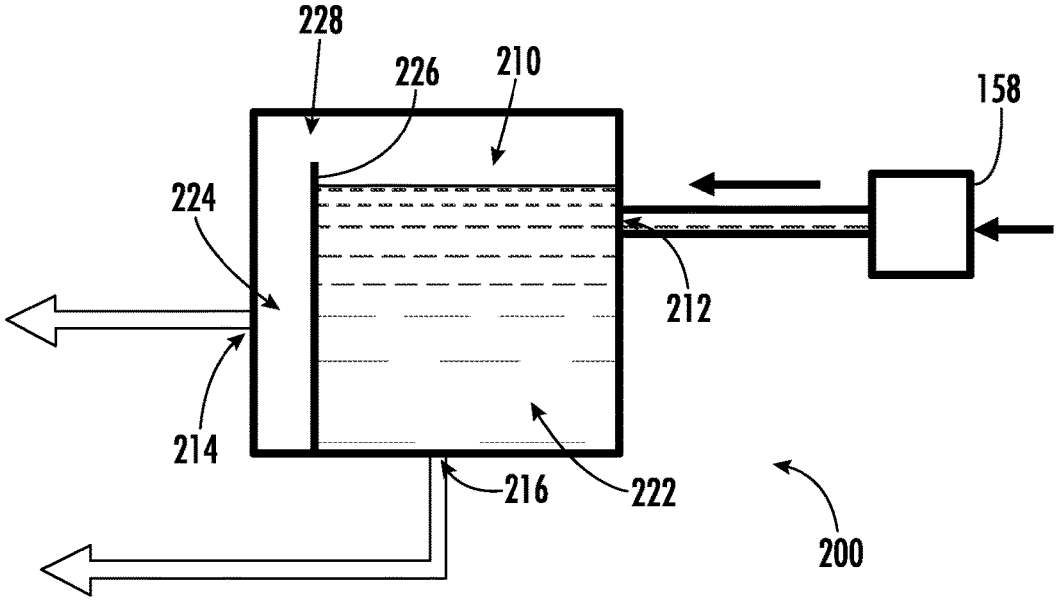
FIG. 4 provides a schematic view of a portion of the exemplary washing machine appliance of FIG. 3.
Figure 5:
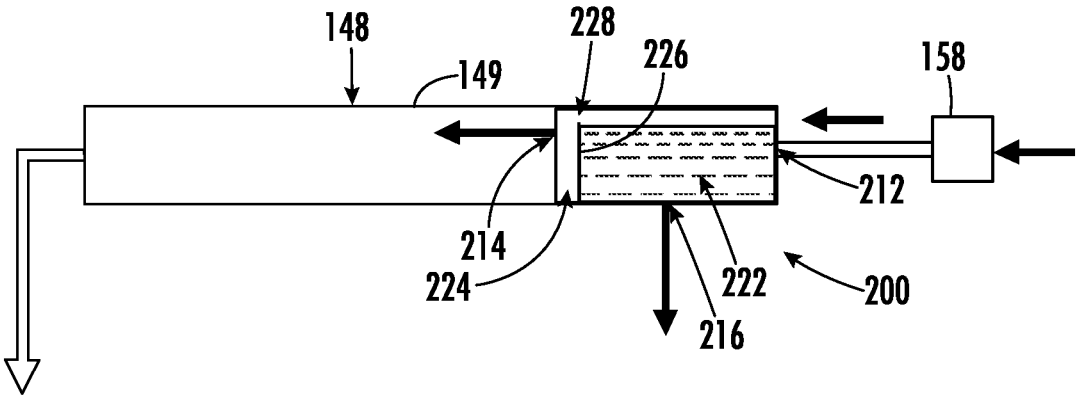
FIG. 5 provides a schematic view of a portion of a washing machine appliance according to exemplary embodiments of the present disclosure.
Figure 6:
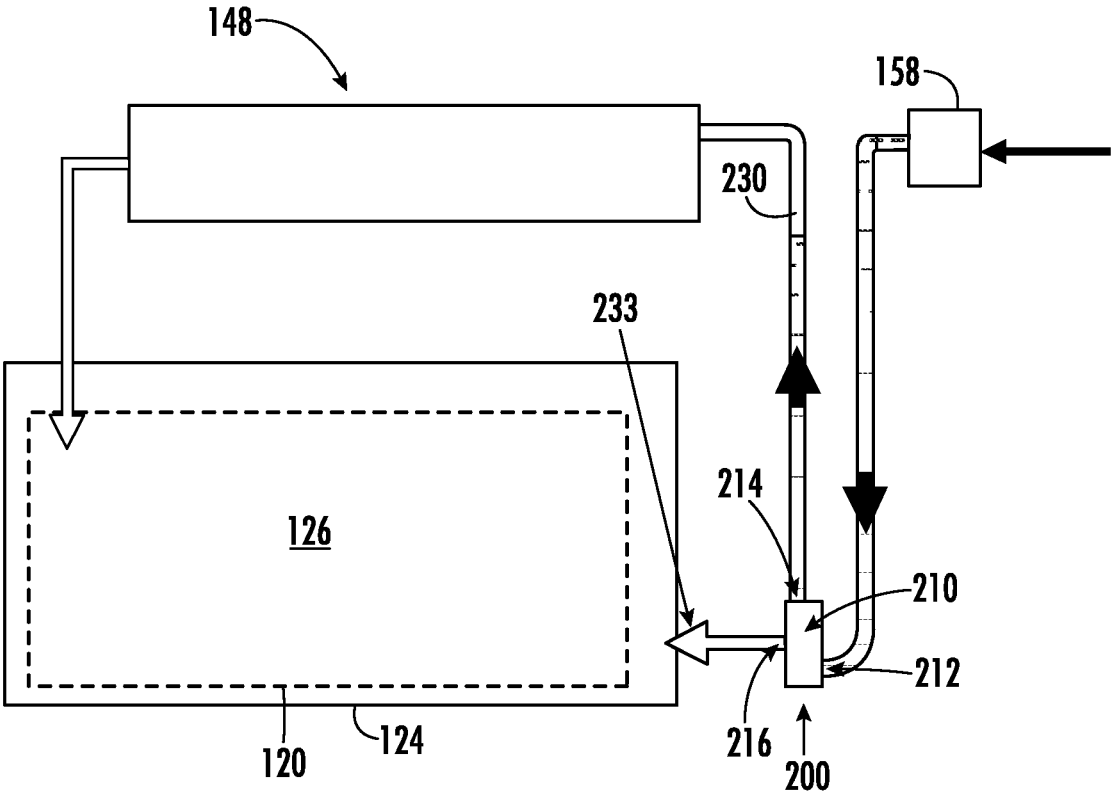
FIG. 6 provides a schematic view of a washing machine appliance according to exemplary embodiments of the present disclosure.

Generally, the passive buffer compartment 200 may be mounted within the cabinet 102 at any suitable position. As an example, and as shown in FIGS. 3 and 4, the passive buffer compartment 200 may be spaced apart from the additive dispensing assembly 148. For instance, the passive buffer compartment 200 may be disposed rearward from the additive dispensing assembly 148. An intermediate water conduit 230 may fluidly connect the passive buffer compartment 200 to the additive dispensing assembly 148. The buffer outlet 216 may be defined through a bottom wall of passive buffer compartment 200 while the dispenser outlet 214 is defined through a side wall of the passive buffer compartment 200. Optionally, and as illustrated in FIG. 6, the passive buffer compartment 200 may be disposed below the additive dispensing assembly 148 or at least a portion of wash tub 124. The intermediate water conduit 230 may thus be required to extend upward from the passive buffer compartment 200 to the additive dispensing assembly 148. The buffer outlet 216 may be defined through a side wall of the passive buffer compartment 200 while the dispenser outlet 214 may be defined through an upper wall of the passive buffer compartment 200. A fluid intake 233 downstream from the buffer outlet 216 may be defined through the wash tub 124 and at least a portion of the passive buffer compartment 200 may be disposed at or below the fluid intake 233. As an additional or alternative example, and as shown in FIG. 5, the passive buffer compartment 200 may be supported or integrated with a housing 149 of the additive dispensing assembly 148. Water bypassing or flowing over the buffer outlet 216 (e.g., defined through a bottom wall of housing 149 or passive buffer compartment 200, generally) may flow from the internal volume 210 of the passive compartment 200 directly, for example, to the detergent drawer 152 (FIG. 2).

Returning generally to FIGS. 2 through 6, and especially to FIG. 2, in exemplary embodiments, during operation of washing machine appliance 100, laundry items are loaded into wash basket 120 through opening 132, and a wash cycle (e.g., including a steam phase) is initiated through operator manipulation of input selectors 162. For example, such a wash cycle may be initiated such that the control valve 158 is opened (e.g., for a set period of time) and then closed. The initial opening of the control valve 158 may dispense a discrete water volume sufficient to fill a portion of the passive buffer compartment 200. For instance, the buffer chamber 222 may be, at least partially, filled without flowing water to the overflow chamber 224. The discrete water volume within the passive buffer compartment 200 may drain to the sump (e.g., through the buffer outlet 216, as described above). Optionally, the opening-closing of the control valve 158 may be repeated to supply a set steam volume to the sump 142 (e.g., without flowing water to the additive dispensing assembly 148 or over clothes within the wash basket 120). In some such embodiments, the set steam volume is determined based on a detected pressure signal from the pressure sensor 176 within the sump 142 (e.g., as described above). Alternatively, a set number of opening-closing instances or intervals of the control valve 158 may be programmed to provide the set steam volume. Upon, or in response to determining the set steam volume is present within the sump 142, the electric heating element 182 may be activated to generate steam within the wash chamber 126, as would be understood. After the steam phase is complete, the heating element 182 may be deactivated.

If a wash phase is provided as part of the cycle, the control valve 158 may be reopened or opened again (e.g., continuously or for an extended period) until a fill condition is met (e.g., a set fill volume corresponding to the load size of articles or wash cycle is provided to the wash tub 124, as determined at the pressure sensor 176). The continuous or extended opening of the control valve 158 may be sufficient to completely fill the passive buffer compartment 200 (e.g., both the buffer chamber 222 and the overflow chamber 224), ensuring at least a portion of the water exits the passive buffer compartment 200 to the additive dispensing assembly 148 (e.g., through the dispenser outlet 214, as described above). Moreover, a wash fluid may be dispensed through the additive dispenser 150, as would be understood. Once wash basket 120 is properly filled with water or wash fluid, the contents of wash basket 120 can be agitated (e.g., with ribs 128) for an agitation phase of laundry items in wash basket 120. During the agitation phase, the basket 120 may be motivated about the axis of rotation A at a set speed (e.g., first speed or tumble speed). As the basket 120 is rotated, articles within the basket 120 may be lifted and permitted to drop therein.

After the agitation phase of the washing operation or wash cycle is completed, wash tub 124 can be drained (e.g., through a drain phase). Laundry articles can then be rinsed (e.g., through a rinse phase) by again adding fluid to wash tub 124, depending on the particulars of the wash cycle selected by a user. Ribs 128 may again provide agitation within wash basket 120. One or more spin phases may also be used. In particular, a spin phase may be applied after the wash cycle or after the rinse cycle in order to wring wash fluid from the articles being washed. During a spin phase, basket 120 is rotated at relatively high speeds (e.g., one or more plaster speeds). Agitation or tumbling of articles may be reduced as basket 120 increases its rotational velocity such that the plaster speed maintains the articles at a generally fixed position relative to basket 120.

After articles disposed in wash basket 120 are cleaned (or the wash cycle otherwise ends), a user can remove the articles from wash basket 120 (e.g., by opening door 134 and reaching into wash basket 120 through opening 132).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:

a cabinet defining an opening to receive articles therethrough;

a tub positioned within the cabinet;

a wash basket rotatably mounted within the tub, the wash basket defining a wash chamber for receiving articles for washing;

an additive dispensing assembly positioned within the cabinet and configured to provide wash fluid to the tub, the additive dispensing assembly comprising a water supply valve to selectively direct water to the tub, a water supply conduit extending between the water supply valve and the tub, and an additive dispenser for storing and dispensing a wash additive, the additive dispenser being in selective fluid communication with the water supply conduit upstream of the tub; and a passive buffer compartment disposed in fluid communication between the water supply valve and the additive dispenser, the passive buffer compartment defining an internal volume, a buffer inlet upstream from the internal volume, a dispenser outlet upstream from the additive dispenser, and a buffer outlet upstream from the tub in fluid parallel to the dispenser outlet to bypass the additive dispenser, wherein the internal volume comprises a buffer chamber and an overflow chamber, the buffer chamber being in fluid communication between the buffer inlet and the buffer outlet, the overflow chamber being in fluid communication between the buffer chamber and the dispenser outlet.

2. The washing machine appliance of claim 1, wherein the buffer outlet is smaller than the buffer inlet to define a sump flowrate less than a buffer flowrate of the buffer inlet.

3. The washing machine appliance of claim 1, wherein the buffer outlet is smaller than the dispenser outlet to define a sump flowrate less than a dispenser flowrate of the dispenser outlet.

4. The washing machine appliance of claim 1, wherein the buffer outlet is disposed below the dispenser outlet.

5. The washing machine appliance of claim 1, wherein the passive buffer compartment further comprises an internal wall disposed between the buffer chamber and the overflow chamber to define a reduced throat restricting water flow from the buffer chamber to the overflow chamber.

6. The washing machine appliance of claim 1, wherein the passive buffer compartment is mounted within the cabinet and spaced apart from the additive dispensing assembly.

7. The washing machine appliance of claim 1, wherein the additive dispensing assembly comprises a housing downstream from the water supply valve, wherein the additive dispenser is supported within the housing, and wherein the passive buffer compartment is disposed within the housing.

8. The washing machine appliance of claim 1, wherein the passive buffer compartment is disposed below the additive dispensing assembly.

9. The washing machine appliance of claim 1, wherein the tub defines a fluid intake downstream from the buffer outlet, and wherein the passive buffer compartment is disposed at or below the fluid intake.

10. The washing machine appliance of claim 1, further comprising an electric heating element disposed on the tub.

11. A washing machine appliance comprising:

a cabinet defining an opening to receive articles therethrough;

a tub positioned within the cabinet;

a wash basket rotatably mounted within the tub, the wash basket defining a wash chamber for receiving articles for washing;

an additive dispensing assembly positioned within the cabinet and configured to provide wash fluid to the tub, the additive dispensing assembly comprising a water supply valve to selectively direct water to the tub, a water supply conduit extending between the water supply valve and the tub, and an additive dispenser for storing and dispensing a wash additive, the additive dispenser being in selective fluid communication with the water supply conduit upstream of the tub;

a passive buffer compartment disposed in fluid communication between the water supply valve and the additive dispenser, the passive buffer compartment defining an internal volume, a buffer inlet upstream from the internal volume, a dispenser outlet upstream from the additive dispenser, and a buffer outlet upstream from the tub in fluid parallel to the dispenser outlet to bypass the additive dispenser, the buffer outlet being smaller than the buffer inlet to define a sump flowrate less than a buffer flowrate of the buffer inlet; and an electric heating element disposed at a bottom end of the tub, wherein the internal volume comprises a buffer chamber and an overflow chamber, the buffer chamber being in fluid communication between the buffer inlet and the buffer outlet, the overflow chamber being in fluid communication between the buffer chamber and the dispenser outlet.

12. The washing machine appliance of claim 11, wherein the buffer outlet is smaller than the dispenser outlet to define the sump flowrate as less than a dispenser flowrate of the dispenser outlet.

13. The washing machine appliance of claim 11, wherein the buffer outlet is disposed below the dispenser outlet.

14. The washing machine appliance of claim 13, wherein the passive buffer compartment further comprises an internal wall disposed between the buffer chamber and the overflow chamber to define a reduced throat restricting water flow from the buffer chamber to the overflow chamber.

15. The washing machine appliance of claim 11, wherein the passive buffer compartment is mounted within the cabinet and spaced apart from the additive dispensing assembly.

16. The washing machine appliance of claim 11, wherein the additive dispensing assembly comprises a housing downstream from the water supply valve, wherein the additive dispenser is supported within the housing, and wherein the passive buffer compartment is disposed within the housing.

17. The washing machine appliance of claim 11, wherein the passive buffer compartment is disposed below the additive dispensing assembly.

18. The washing machine appliance of claim 11, wherein the tub defines a fluid intake downstream from the buffer outlet, and wherein the passive buffer compartment is disposed below the fluid intake.

19. A washing machine appliance comprising:

a tub;

a wash basket mounted within the tub;

an additive dispenser in selective fluid communication with the tub; and a passive buffer compartment disposed in upstream fluid communication with the additive dispenser, the passive buffer compartment defining an internal volume, a buffer inlet upstream from the internal volume, a dispenser outlet upstream from the additive dispenser, and a buffer outlet upstream from the tub in fluid parallel to the dispenser outlet to bypass the additive dispenser, wherein the internal volume comprises a buffer chamber and an overflow chamber, the buffer chamber being in fluid communication between the buffer inlet and the buffer outlet, the overflow chamber being in fluid communication between the buffer chamber and the dispenser outlet.

20. The washing machine appliance of claim 19, wherein the passive buffer compartment further comprises an internal wall disposed between the buffer chamber and the overflow chamber to define a reduced throat restricting water flow from the buffer chamber to the overflow chamber.

* * * * *